US010748467B2

(12) United States Patent
Yang et al.

(10) Patent No.: US 10,748,467 B2
(45) Date of Patent: Aug. 18, 2020

(54) DISPLAY PANEL, DISPLAY METHOD THEREOF AND DISPLAY DEVICE

(71) Applicant: BOE Technology Group Co., Ltd., Beijing (CN)

(72) Inventors: Hualing Yang, Beijing (CN); Lina Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/434,842

(22) Filed: Jun. 7, 2019

(65) Prior Publication Data

US 2020/0035141 A1 Jan. 30, 2020

(30) Foreign Application Priority Data

Jul. 27, 2018 (CN) ..... 2018 1 0846854

(51) Int. Cl.
*G09G 3/20* (2006.01)
*G09G 5/02* (2006.01)

(52) U.S. Cl.
CPC ..... *G09G 3/2003* (2013.01); *G09G 5/02* (2013.01); *G09G 2320/0233* (2013.01); *G09G 2330/10* (2013.01)

(58) Field of Classification Search
CPC ..... G09G 3/2003; G09G 2320/0233; G09G 2330/10; G09G 5/02
See application file for complete search history.

(56) References Cited

U.S. PATENT DOCUMENTS

2015/0091953 A1* 4/2015 Wu ..... G09G 3/2007 345/690
2016/0155394 A1* 6/2016 Im ..... G09G 3/3426 345/694

(Continued)

FOREIGN PATENT DOCUMENTS

CN 107479269 A 12/2017
CN 107526201 A 12/2017

(Continued)

OTHER PUBLICATIONS

Chinese Office Action for 201810846854.X dated Nov. 25, 2019.

(Continued)

*Primary Examiner* — Tom V Sheng
(74) *Attorney, Agent, or Firm* — Arent Fox LLP; Michael Fainberg

(57) ABSTRACT

A display panel, a display method thereof and a display device are provided. The display panel includes a display area, a non-display area separated from the display area by the special-shape edge, and a driver chip, wherein the display area includes first pixels proximate to the special-shape edge, and second pixels away from the special-shape edge, and the first pixel is divided into a first part in the display area and a second part in the non-display area; and for the first pixel, the driver chip is configured: to determine a target grayscale value G of each first pixel according to $G=255*K^{(1/2.2)}$; and to replace the current grayscale value corresponding to the first pixel in the current grayscale database of the display panel with the target grayscale value G, to form a target grayscale database.

9 Claims, 3 Drawing Sheets

(56) References Cited

U.S. PATENT DOCUMENTS

| | | | | |
|---|---|---|---|---|
| 2016/0203751 | A1* | 7/2016 | Suginohara | G09G 3/2074 345/694 |
| 2017/0213507 | A1* | 7/2017 | Lin | G09G 3/3696 |
| 2017/0301314 | A1* | 10/2017 | Kim | G09G 5/10 |
| 2018/0075797 | A1* | 3/2018 | Park | G09G 5/10 |
| 2018/0122283 | A1* | 5/2018 | Kim | G09G 3/2003 |
| 2018/0130397 | A1 | 5/2018 | Zheng et al. | |
| 2018/0144675 | A1* | 5/2018 | Lee | G09G 3/2092 |
| 2018/0357979 | A1* | 12/2018 | Nakamura | G09G 5/10 |
| 2019/0019849 | A1 | 1/2019 | Zheng et al. | |
| 2019/0080648 | A1* | 3/2019 | Hwang | G09G 3/3266 |

FOREIGN PATENT DOCUMENTS

| | | | |
|---|---|---|---|
| CN | 107622735 | A | 1/2018 |
| CN | 107665637 | A | 2/2018 |
| CN | 108475489 | A | 8/2018 |

OTHER PUBLICATIONS

Wang Lingjiege, "The Meaning of Gamma in TFT-LCD" https://zhidao.baidu.com/question/557570105224773572. htmldevice, Dec. 16, 2017.

* cited by examiner

DISPLAY PANEL, DISPLAY METHOD THEREOF AND DISPLAY DEVICE

CROSS-REFERENCES TO RELATED APPLICATION

This application claims priority to Chinese patent application No. 201810846854.X filed on Jul. 27, 2018, which is incorporated herein by reference in its entirety.

FIELD

The present disclosure relates to the field of display technologies, and particularly to a display panel, a display method thereof and a display device.

BACKGROUND

With the development of the display technologies, a display device gradually tends towards including a narrow bezel or no bezel, and the shape of a display panel is not limited to a rectangle or another regular shape any longer, but a special-shape display panel is gradually emerging in our life. For example, four corners of a full screen display panel are designed as rounded corners, or a grooved structure is arranged on the display panel to accommodate a headphone, a camera lens, or another modules, or arranged on a display panel in a round or another shape for a watch, a wearable phone, or another device.

SUMMARY

In one aspect, an embodiment of the disclosure provides a display panel. The display panel includes a display area with a special-shape edge, a non-display area separated from the display area by the special-shape edge, and a driver chip, wherein the display area includes a plurality of first pixels proximate to the special-shape edge, and a plurality of second pixels away from the special-shape edge, and at least one of the first pixels is divided by the special-shape edge into a first part in the display area and a second part in the non-display area. For at least one of the first pixels, the driver chip is configured: to determine a target grayscale value G of the first pixel according to $G=255*K^{(1/2.2)}$, wherein K is a pre-stored ratio of an area of the first part of the first pixel to the total area of the first pixel; and to replace a current grayscale value corresponding to the first pixel in a current grayscale database of the display panel with the target grayscale value G, to form a target grayscale database, wherein the current grayscale database is a database of pixel information of the pixels, including their current grayscale values, created using a gamma correction curve of the display panel.

In some embodiments, the pixel information of each pixel includes information about a correspondence relationship between positional information of the pixel and a current grayscale value thereof, and the driver chip is configured: to replace the current grayscale value corresponding to a positional information of the first pixel in the current grayscale database of the display panel with the target grayscale value G of the first pixel based upon the positional information, to form the target grayscale database.

In some embodiments, the pixels in the display area are arranged in array in a first direction and a second direction, wherein the first direction and the second direction are orthogonal to each other; and the positional information of each pixel is coordinates of the pixel in a preset coordinate system, and the preset coordination system is a coordinate system including coordinate axes arranged respectively in the first direction and the second direction.

In some embodiments, the driver chip is further configured: to determine a target data voltage of each of the first pixels according to the target grayscale value corresponding to each of the first pixels in the target grayscale database, and to determine an initial data voltage of each of the second pixels according to the current grayscale value corresponding to each of the second pixels in the target grayscale database; and to control the first pixels to display at their target data voltages, and to control the second pixels to display at their initial data voltages.

In another aspect, an embodiment of the disclosure further provides a display device including the display panel according to any one of the technical solutions above.

In still another aspect, an embodiment of the disclosure provides a display method of a display panel. The display panel includes a display area with a special-shape edge, a non-display area separated from the display area by the special-shape edge, and a driver chip, wherein the display area includes a plurality of first pixels proximate to the special-shape edge, and a plurality of second pixels away from the special-shape edge, and at least one of the first pixels is divided by the special-shape edge into a first part in the display area and a second part in the non-display area; and the display method includes: for at least one of the first pixels, determining a target grayscale value G of the first pixel according to $G=255*K^{(1/2.2)}$, wherein K is a pre-stored ratio of an area of the first part of the first pixel to a total area of the first pixel; and replacing a current grayscale value corresponding to the first pixel in a current grayscale database of the display panel with the target grayscale value G, to form a target grayscale database, wherein the current grayscale database is a database of pixel information of the pixels, including their current grayscale values, created using a gamma correction curve of the display panel.

In some embodiments, the pixel information of each of the pixels includes information about a correspondence relationship between positional information of the pixel and a current grayscale thereof, and replacing the current grayscale value corresponding to the first pixel in the current grayscale database of the display panel with the target grayscale value G, to form the target grayscale database includes: replacing the current grayscale value corresponding to a positional information of the first pixel in the current grayscale database of the display panel with the target grayscale value G of the first pixel based upon the positional information, to form the target grayscale database.

In some embodiments, the pixels in the display area are in array in a first direction and a second direction, wherein the first direction and the second direction are orthogonal to each other; and the positional information of each of the pixels is coordinates of the pixel in a preset coordinate system, and the preset coordination system is a coordinate system including coordinate axes respectively in the first direction and the second direction.

In some embodiments, the display method further includes: determining a target data voltage of each of the first pixels according to the target grayscale value corresponding to each of the first pixels in the target grayscale database, and determining an initial data voltage of each of the second pixels according to the current grayscale value corresponding to each of the second pixels in the target grayscale database; and controlling the first pixels to display at their target data voltages, and controlling the second pixels to display at their initial data voltages.

DETAILED DESCRIPTION

In order to make the objects, technical solutions, and advantages of the disclosure more apparent, the disclosure will be described below in further details with reference to the embodiments thereof.

Figure 1:
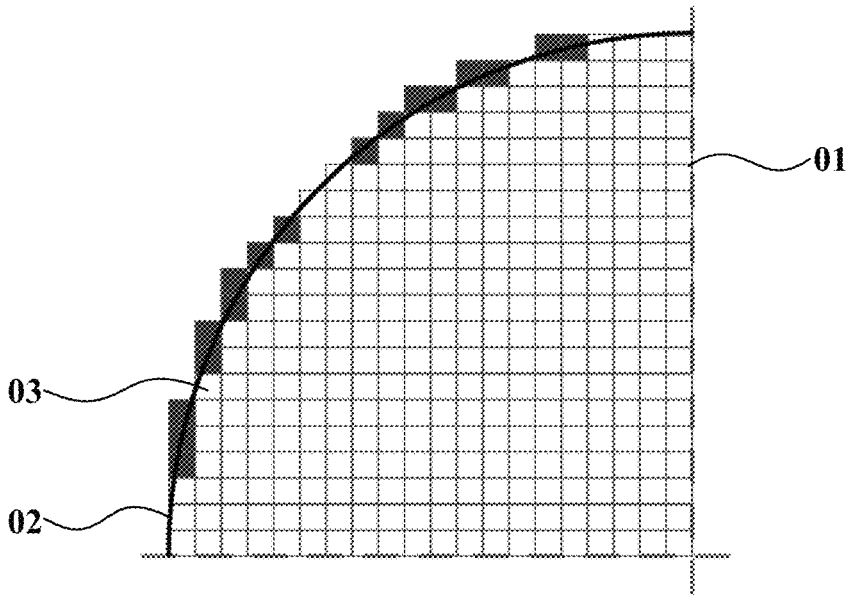
FIG. 1 is a schematic structural diagram of a display panel in the related art.

FIG. 1 shows a schematic structure of a special-shape display panel in the related art. Since the edge of a display area 01 of the special-shape display panel is a special-shape edge 02, and pixels of the display panel are generally structured in a rectangle or another regular shape, pixels 03 at the special-shape edge 02 of the display area 01 may not exactly match with the special-shape edge 02, so that a part of each pixel 03 is located in the display area 01, and the other part thereof extends out of the display area 01. In the related art, whether the pixel 03 is to emit light is typically determined by the ratio of the area of the part of the pixel 03 in the display area 01 to the total area of the pixel 03, so that there may be saw teeth and thus a color cast in the special-shape edge 02 of the display panel.

In order to alleviate the problems of saw teeth and a color cast at the edge of the display panel, thus improving the display effect of the display panel, the embodiments of the disclosure provide a display panel, a display method thereof, and a display device.

Figure 2:
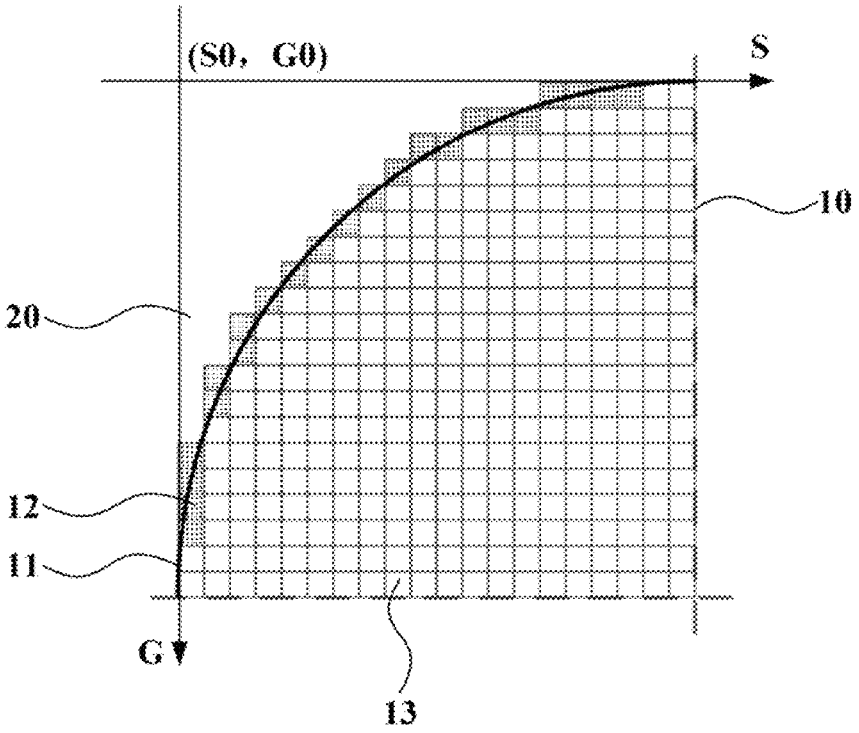
FIG. 2 is a schematic structural diagram of a display panel according to an embodiment of the disclosure.
Figure 3:
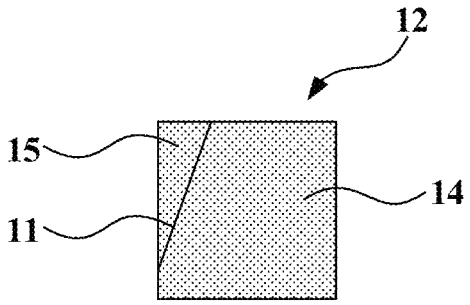
FIG. 3 is a schematic structural diagram of a first pixel according to an embodiment of the disclosure.
Figure 4:
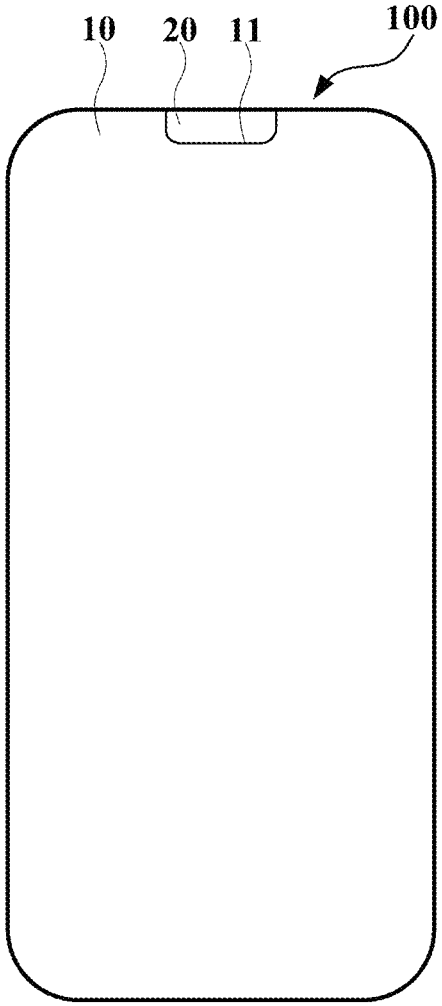
FIG. 4 is a schematic structural diagram of a display device according to an embodiment of the disclosure.

As illustrated in FIG. 2, FIG. 3, and FIG. 4, a display panel according to an embodiment of the disclosure includes a display area 10 with a special-shape edge 11, a non-display area 20 separated from the display area 10 by the special-shape edge 11, and a driver chip (not illustrated). The display area 10 includes a plurality of first pixels 12 arranged proximate to the special-shape edge 11, and a plurality of second pixels 13 arranged away from the special-shape edge 11, and the first pixel 12 is divided by the special-shape edge 11 into a first part 14 in the display area 10, and a second part 15 in the non-display area 20.

For the first pixel 12, the driver circuit is configured: to determine a target grayscale value G of the first pixel 12 according to $G=255*K^{(1/2.2)}$, where K is the pre-stored ratio of the area of the first part 14 of the first pixel 12 to the total area of the first pixel 12; and to replace the current grayscale value corresponding to the first pixel 12 in the current grayscale database of the display panel with the target grayscale value G, to form a target grayscale database, where the current grayscale database is a database of pixel information of the respective pixels, including their current grayscale values, created using a gamma correction curve of the display panel.

Those skilled in the art can know that there is such a nonlinear gamma response between input voltage of a pixel and output luminance thereof that results in an inherent distortion of display luminance, that is, luminance at a low grayscale is lower as a gamma value is increasing, and since human eyes are the most sensitive to a change in luminance at a low grayscale, and this nonlinear visual response is similar to an inverted curve of the gamma response, the grayscale value can be corrected in the inverse gamma form so that the luminance at the grayscale can be alleviated or even avoided from being distorted. The grayscale values corresponding to the respective pixels in the current grayscale database in the embodiment of the disclosure are obtained by gamma-correction.

In the display panel according to the embodiment of the disclosure, the luminance L of light emitted by the first pixel 12 can be determined according to the ratio of the area of the first part thereof in the display area 10 to the total area thereof, and specifically when the luminance L of light emitted by each first pixel 12 satisfies $L=K*L_{max}$, the display luminance at the special-shape edge 11 can satisfy a visual experience of human eyes while alleviating saw teeth and a color cast at the special-shape edge 11 in the related art, that is, the luminance at the special-shape edge 11, perceived by the human eyes can agree with the luminance at the center of the display area 10, where K is the ratio of the area of the first part 14 of the first pixel 12 in the display area 10 to the total area thereof, and $L_{max}$ is the maximum luminance L of emitted light. Hereupon $G=255*K^{(1/2.2)}$ can be derived inversely from $L=L_{max}*(G/255)^{2.2}$, so that the target grayscale value G corresponding to the luminance L of light emitted by each first pixel 12 can be obtained, and then the current grayscale value corresponding to each first pixel 12 in the current grayscale database can be replaced with the target grayscale value thereof, thus creating the target grayscale database; and when an image are displayed at the respective pixels in the display area 10 according to their corresponding grayscale values in the target grayscale database, saw teeth and a color deviation at the special-shape edge can be alleviated to thereby improve the display effect of the display panel. Moreover the grayscale values of the first pixels 12 can be adjusted as described above by the driver chip, that is, the driver chip in the embodiment of the disclosure can be integrated with a function of controlling the grayscales of the respective pixels to thereby adjust their grayscale values flexibly and accurately.

In some embodiments of the disclosure, the pixel information of each pixel includes information about a correspondence relationship between positional information of the pixel, and the current grayscale value thereof, and the driver chip is specifically configured: to replace the current grayscale value corresponding to the positional information of the first pixel 12 in the current grayscale database of the display panel with the target grayscale value G of the first pixel 12 based upon the positional information, to form the target grayscale database.

In the display panel according to the embodiment of the disclosure, with the specific positional information of each pixel in the display area 10, the current grayscale value of the pixel can be determined based upon the positional information, thus making it easier to replace the current grayscale value with the target grayscale value.

In some embodiments, as illustrated in FIG. 2, the pixels in the display area 10 are arranged in array in a first direction S and a second direction G, where the first direction S and the second direction G are arranged orthogonal to each other; and the positional information of each pixel is coordinates of the pixel in a preset coordinate system, where the preset coordination system is a coordinate system including coordinate axes arranged respectively in the first direction S and the second direction G. In the display panel according to this embodiment, the positional information of each pixel is specifically the coordinates thereof in the preset coordinate system, so the correspondence relationship between the positional information and the current grayscale value can be created more intuitively, where the specific position of the coordinate origin of the preset coordinate system will not be limited to any specific position, and for example, the coordinate origin is positioned in the non-display area 20 of the display panel in the embodiment as illustrated in FIG. 2.

In some embodiments of the embodiment of the disclosure, the driver chip is further configured: to determine a target data voltage of each first pixel according to the target grayscale value corresponding to each first pixel in the target grayscale database, and to determine an initial data voltage of each second pixel according to the current grayscale value corresponding to each second pixel in the target grayscale database; and to control the first pixels to display at their target data voltages, and to control the second pixels to display at their initial data voltages.

As illustrated in FIG. 4, an embodiment of the disclosure further provides a display device 100 including the display panel according to any one of the technical solutions above. The display device has a better display effect.

Figure 5:
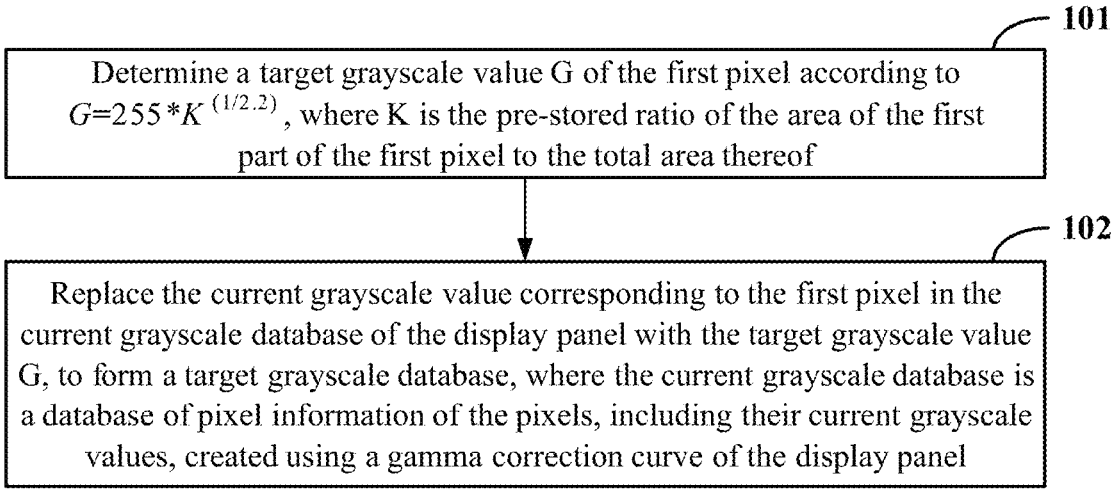
FIG. 5 is a flow chart of a display method of a display panel according to an embodiment of the disclosure.

As illustrated in FIG. 5, based upon the same inventive idea, an embodiment of the disclosure further provides a display method of a display panel. The display panel includes a display area with a special-shape edge, a non-display area separated from the display area by the special-shape edge, and a driver chip, where the display area includes a plurality of first pixels arranged proximate to the special-shape edge, and a plurality of second pixels arranged away from the special-shape edge, and each first pixel is divided by the special-shape edge into a first part in the display area, and a second part in the non-display area. The display method includes the following steps.

The step 101 is, for the first pixel, to determine a target grayscale value G of the first pixel according to $G=255*K^{(1/2.2)}$, where K is the pre-stored ratio of the area of the first part of the first pixel 12 to the total area of the first pixel 12.

The step 102 is to replace the current grayscale value corresponding to the first pixel in the current grayscale database of the display panel with the target grayscale value G, to form a target grayscale database, where the current grayscale database is a database of pixel information of the respective pixels, including their current grayscale values, created using a gamma correction curve of the display panel.

Alike in the method according to the embodiment of the disclosure, the luminance L of light emitted by the first pixel can be determined according to the ratio of the area of the first part thereof in the display area to the total area thereof. Specifically when the luminance L of light emitted by each first pixel satisfies $L=K*L_{max}$, the display luminance at the special-shape edge can satisfy a visual experience of human eyes while alleviating saw teeth and a color cast at the special-shape edge in the related art, that is, the luminance at the special-shape edge, perceived by the human eyes can agree with the luminance at the center of the display area, where K is the ratio of the area of the first part of the first pixel in the display area to the total area thereof, and $L_{max}$ is the maximum luminance L of emitted light. Hereupon $G=255*K^{(1/2.2)}$ can be derived inversely from $L=L_{max}*(G/255)^{2.2}$, so that the target grayscale value G corresponding to the luminance L of light emitted by each first pixel can be obtained, and then the current grayscale value corresponding to each first pixel in the current grayscale database can be replaced with the target grayscale value thereof, thus creating the target grayscale database; and when an image are displayed at the respective pixels in the display area according to their corresponding grayscale values in the target grayscale database, saw teeth and a color deviation at the special-shape edge can be alleviated to thereby improve the display effect of the display panel.

In some embodiments, the pixel information of each pixel includes information about a correspondence relationship between positional information of the pixel, and the current grayscale value thereof. The step of replacing the current grayscale value corresponding to the first pixel in the current grayscale database of the display panel with the target grayscale value G to form the target grayscale database includes: replacing the current grayscale value corresponding to the positional information of the first pixel in the current grayscale database of the display panel with the target grayscale value G of the first pixel based upon the positional information, to form the target grayscale database.

In some embodiments, the pixels in the display area are arranged in array in a first direction and a second direction, where the first direction and the second direction are orthogonal to each other; and the positional information of each pixel is coordinates of the pixel in a preset coordinate system, where the preset coordination system is a coordinate system including coordinate axes arranged respectively in the first direction and the second direction.

In some embodiments, the display method further includes: determining a target data voltage of each first pixel according to the target grayscale value corresponding to each first pixel in the target grayscale database, and determining an initial data voltage of each second pixel according to the current grayscale value corresponding to each second pixel in the target grayscale database; and controlling the first pixels to display at their target data voltages, and controlling the second pixels to display at their initial data voltages.

The display method above of a display panel can alleviate the problems of saw teeth and a color cast at the special-shape edge of the display panel, thus improving the display effect of the display panel.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A display panel, comprising: a display area with a special-shape edge, a non-display area separated from the display area by the special-shape edge, and a driver chip, wherein the display area comprises a plurality of first pixels proximate to the special-shape edge, and a plurality of second pixels away from the special-shape edge, and at least one of the first pixels is divided by the special-shape edge into a first part in the display area and a second part in the non-display area; and for at least one of the first pixels, the driver chip is configured:

to determine a target grayscale value G of the first pixel according to $G=255*K^{(1/2.2)}$, wherein K is a pre-stored ratio of an area of the first part of the first pixel to a total area of the first pixel; and to replace a current grayscale value corresponding to the first pixel in a current grayscale database of the display panel with the target grayscale value G, to form a target grayscale database, wherein the current grayscale database is a database of pixel information of pixels, comprising their current grayscale values, created using a gamma correction curve of the display panel.

2. The display panel according to claim 1, wherein the pixel information of each of the pixels comprises information about a correspondence relationship between positional information of the pixel and a current grayscale value thereof, and the driver chip is configured:

to replace the current grayscale value corresponding to a positional information of the first pixel in the current grayscale database of the display panel with the target grayscale value G of the first pixel based upon the positional information, to form the target grayscale database.

3. The display panel according to claim 2, wherein the pixels in the display area are in array in a first direction and a second direction, wherein the first direction and the second direction are orthogonal to each other; and the positional information of each of the pixels is coordinates of the pixel in a preset coordinate system, and the preset coordination system is a coordinate system comprising coordinate axes respectively in the first direction and the second direction.

4. The display panel according to claim 1, wherein the driver chip is further configured:

to determine a target data voltage of each of the first pixels according to the target grayscale value corresponding to each of the first pixels in the target grayscale database, and to determine an initial data voltage of each of the second pixels according to the current grayscale value corresponding to each of the second pixels in the target grayscale database; and to control the first pixels to display at their target data voltages, and to control the second pixels to display at their initial data voltages.

5. A display device, comprising the display panel according to claim 1.

6. A display method of a display panel, wherein the display panel comprising a display area with a special-shape edge, a non-display area separated from the display area by the special-shape edge, and a driver chip, wherein the display area comprises a plurality of first pixels proximate to the special-shape edge, and a plurality of second pixels away from the special-shape edge, and at least one of the first pixels is divided by the special-shape edge into a first part in the display area and a second part in the non-display area; and the display method comprises:

for at least one of the first pixels, determining a target grayscale value G of the first pixel according to $G=255*K^{(1/2.2)}$, wherein K is a pre-stored ratio of an area of the first part of the first pixel to a total area of the first pixel; and replacing a current grayscale value corresponding to the first pixel in a current grayscale database of the display panel with the target grayscale value G, to form a target grayscale database, wherein the current grayscale database is a database of pixel information of pixels, comprising their current grayscale values, created using a gamma correction curve of the display panel.

7. The display method according to claim 6, wherein the pixel information of each of the pixels comprises information about a correspondence relationship between positional information of the pixel and a current grayscale value thereof, and replacing the current grayscale value corresponding to the first pixel in the current grayscale database of the display panel with the target grayscale value G, to form the target grayscale database comprises:

replacing the current grayscale value corresponding to a positional information of the first pixel in the current grayscale database of the display panel with the target grayscale value G of the first pixel based upon the positional information, to form the target grayscale database.

8. The display method according to claim 7, wherein the pixels in the display area are in array in a first direction and a second direction, wherein the first direction and the second direction are orthogonal to each other; and the positional information of each of the pixels is coordinates of the pixel in a preset coordinate system, and the preset coordination system is a coordinate system comprising coordinate axes respectively in the first direction and the second direction.

9. The display method according to claim 6, further comprising:

determining a target data voltage of each of the first pixels according to the target grayscale value corresponding to each of the first pixels in the target grayscale database, and determining an initial data voltage of each of the second pixels according to the current grayscale value corresponding to each of the second pixels in the target grayscale database; and controlling the first pixels to display at their target data voltages, and controlling the second pixels to display at their initial data voltages.

* * * * *